US006874994B2

(12) United States Patent
Folsom et al.

(10) Patent No.: US 6,874,994 B2
(45) Date of Patent: Apr. 5, 2005

(54) HYDRAULIC PUMP AND MOTOR

(75) Inventors: Lawrence R. Folsom, Castleton, NY (US); Clive Tucker, Castleton, NY (US)

(73) Assignee: Folsom Technologies, Inc., Castleton, NY (US)

( * ) Notice: Subject to any disclaimer, the term of this patent is extended or adjusted under 35 U.S.C. 154(b) by 59 days.

(21) Appl. No.: 10/311,983

(22) PCT Filed: Jun. 20, 2001

(86) PCT No.: PCT/US01/19836

§ 371 (c)(1),
(2), (4) Date: Dec. 20, 2002

(87) PCT Pub. No.: WO01/98659

PCT Pub. Date: Dec. 27, 2001

(65) Prior Publication Data

US 2004/0126245 A1 Jul. 1, 2004

Related U.S. Application Data

(60) Provisional application No. 60/212,893, filed on Jun. 20, 2000.

(51) Int. Cl.[7] ..... F04B 19/24; F04B 49/00; F01B 13/04; F01B 15/00

(52) U.S. Cl. ..... 417/209; 417/212; 92/57; 92/66; 91/504; 91/505; 91/506

(58) Field of Search ..... 417/209, 212; 92/57, 56, 66; 91/504, 505, 506

(56) References Cited

U.S. PATENT DOCUMENTS

| | | | | | |
|---|---|---|---|---|---|
| 3,149,577 | A | * | 9/1964 | Gregor | 91/505 |
| 3,739,692 | A | * | 6/1973 | Bell | 91/506 |
| 4,405,288 | A | * | 9/1983 | Stockton | 417/220 |
| 5,052,898 | A | * | 10/1991 | Cook | 417/269 |
| 6,092,457 | A | * | 7/2000 | Inoue et al. | 92/129 |
| 6,203,283 | B1 | * | 3/2001 | Fleming et al. | 417/222.1 |
| 6,368,072 | B1 | * | 4/2002 | Inoue et al. | 417/269 |

* cited by examiner

*Primary Examiner*—Cheryl J. Tyler
*Assistant Examiner*—Timothy P. Solak
(74) *Attorney, Agent, or Firm*—J. Michael Neary

(57) ABSTRACT

A hydraulic unit has a drive shaft (52) mounted in a manifold block (54) and coupled to a torque plate (80) on a central axis. A bent axis motive unit (60) has a yoke connected to the manifold block supported for rotation on the yoke. Hollow pistons (100) in cylinders in the cylinder block allow fluid to flow through a torque plate into and form the manifold without the necessity for passing fluid through an articulating member that pivots the cylinder block.

14 Claims, 18 Drawing Sheets

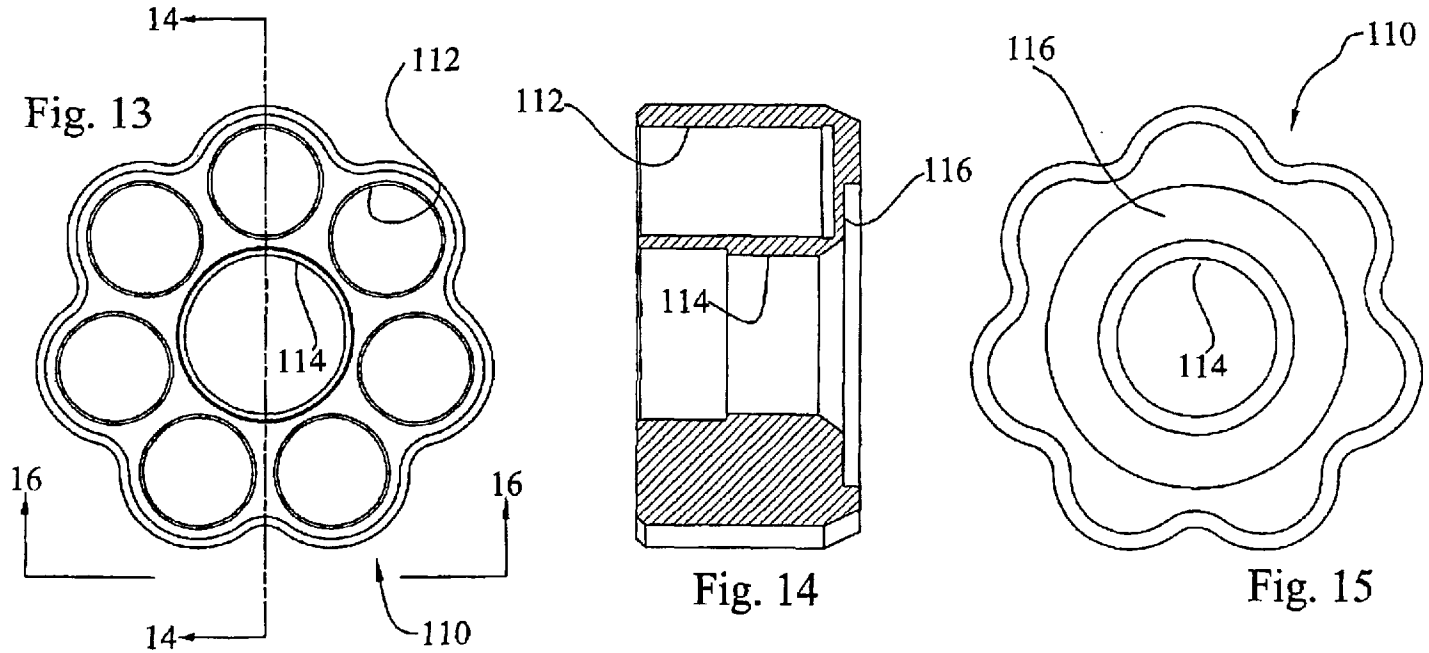
Fig. 13
Fig. 14
Fig. 15
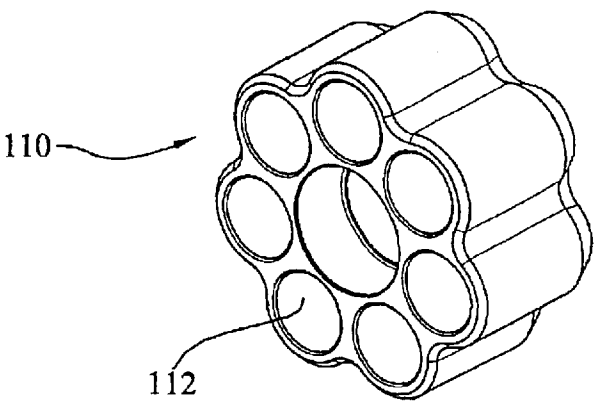
Fig. 12
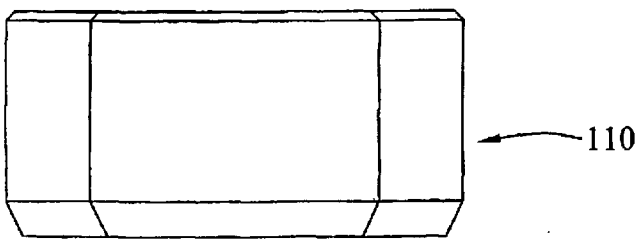
Fig. 16

HYDRAULIC PUMP AND MOTOR

This is related to U.S. Provisional Applications No. 60/212,893 filed on Jun. 20, 2000 and to International Application PCT/US01/19836 filed on Jun. 20, 2001 and entitled "Hydraulic Pump and Motor."

This invention pertains to a continuously variable hydromechanical pumps and motors, and more particularly to an efficient and economical bent axis pump and motor.

BACKGROUND OF THE INVENTION

Hydraulic pumps and motors are widely used in industry in many applications in which electric motors are not suitable. A durable, long lived variable displacement pump/motor is needed having reliable precise controls.

SUMMARY OF THE INVENTION

Accordingly, it is an object of this invention to provide an improved hydraulic pump and motor These and other objects are attained in a pump/motor having a rotating element and a non-rotating element. Each non-rotating pump element is mounted for tilting movement in the housing. The tilting axis of the non-rotating element lies transverse to the axis of rotation of the rotating element. The pump/motor displacement is controlled by the tilt angle of the non-rotating elements. A tilt angle control apparatus attached to the housing and to the non-rotating elements governs that tilt angle.

DESCRIPTION OF THE DRAWINGS

The invention and its many attendant objects and advantages will be better understood upon reading the following detailed description of the preferred embodiment in conjunction with the following drawings, wherein:

FIGS. 12–16 are various views of the cylinder block in the unit shown in FIG. 4;

DESCRIPTION OF THE PREFERRED EMBODIMENT

Figure 1:
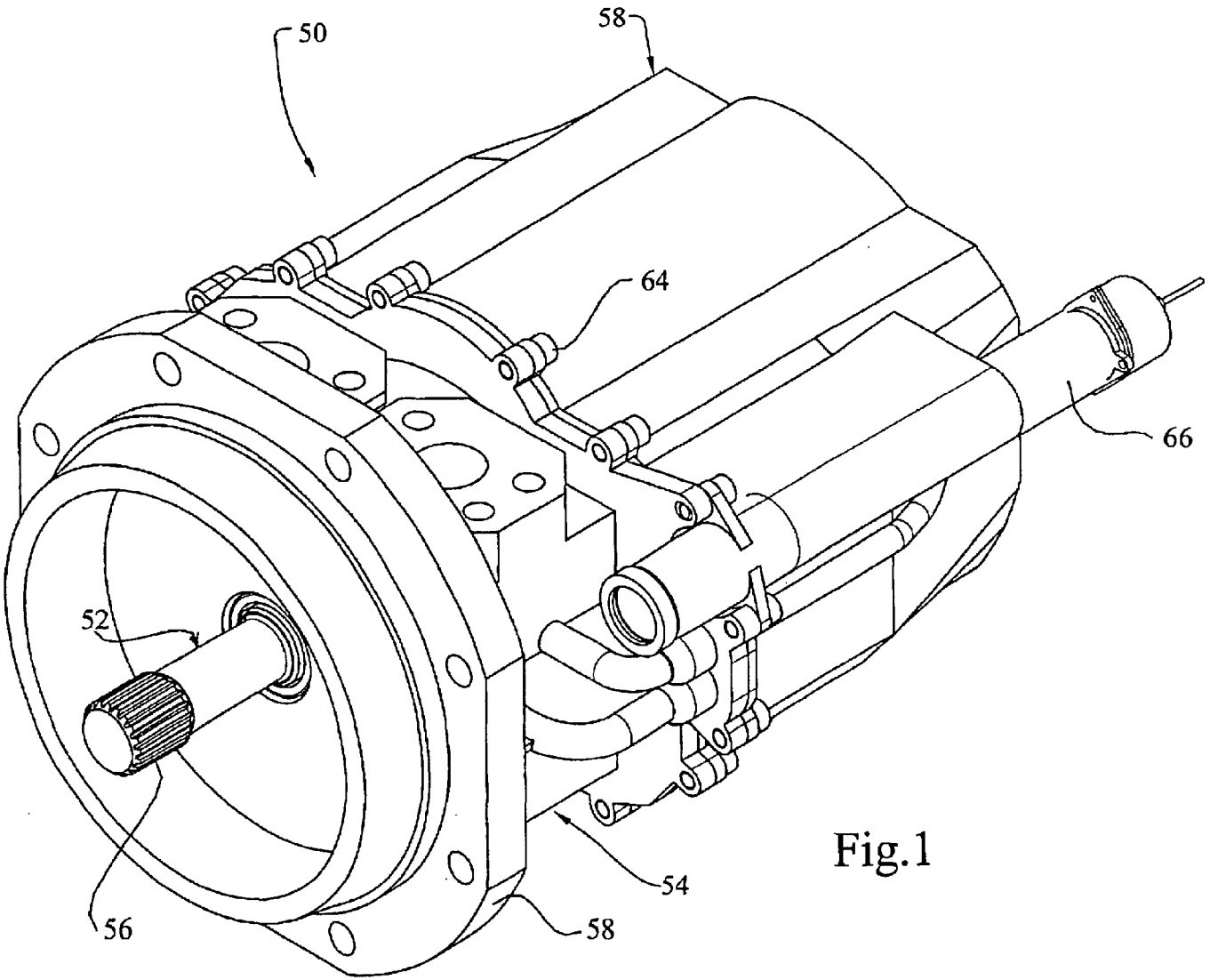
FIG. 1 is a perspective view from the drive shaft side of one version of the pump/motor in accordance with this invention.

Turning now to the drawings, and more particularly to FIG. 1 thereof, a variable displacement hydraulic pump/motor 50 is shown having a drive shaft 52 journaled for rotation in needle bearings 53 and 55 in a manifold block 54, shown in detail in FIGS. 25–30. The drive shaft is splined at its outer end 56 for torque coupling to a driving or driven element. The manifold block 54 has a front mounting flange for attachment to related driving or driven equipment, shown schematically at 57. The pump/motor 50 can be operated as either a pump or as a motor, depending on whether power is input in the form of mechanical torque to the drive shaft 52 (in which case it operates as a pump) or in the form of a flow of pressurized hydraulic fluid (in which case it operates as a hydraulic motor.)

Figure 2:
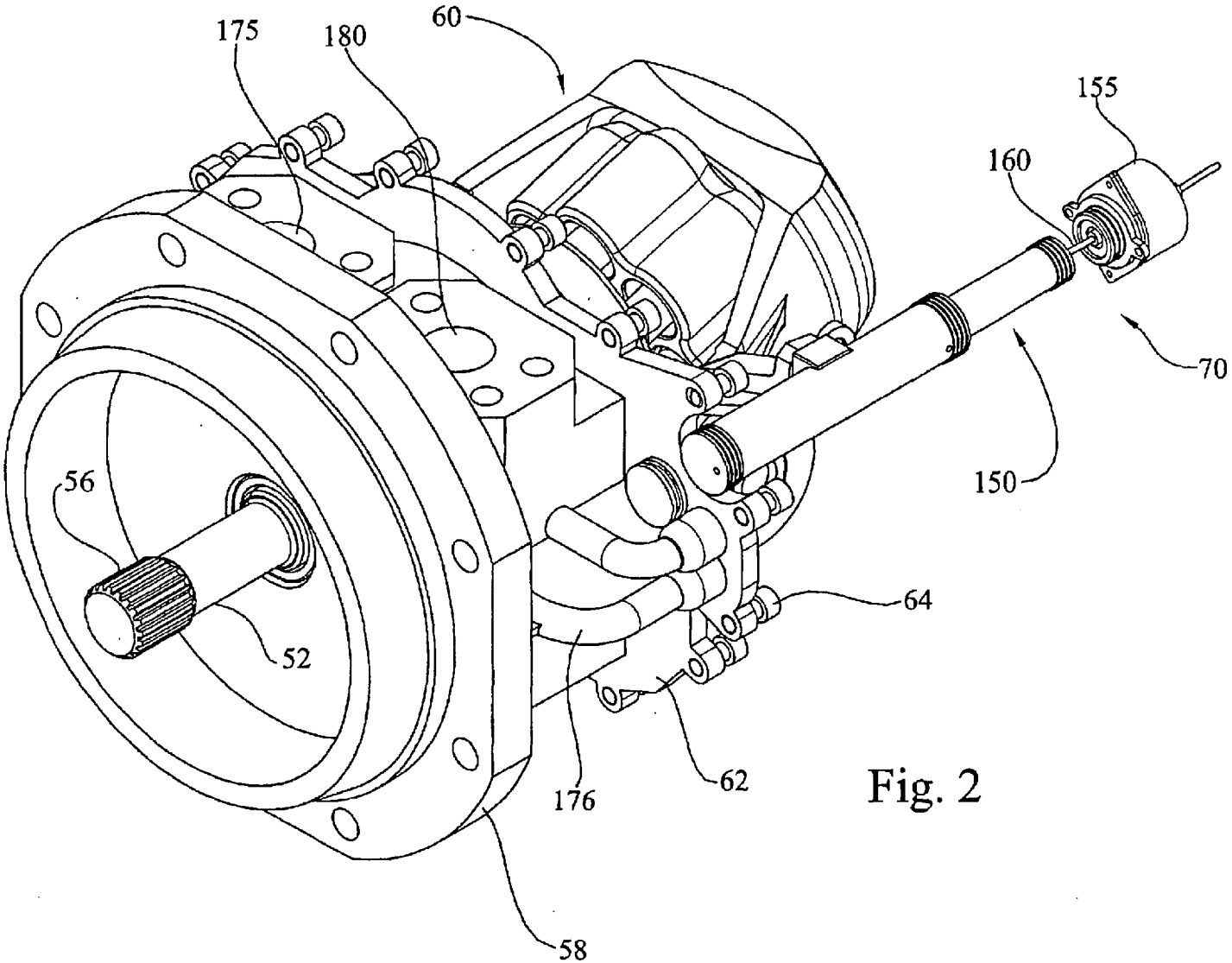
FIG. 2 is a perspective view from the drive shaft side of the pump/motor unit shown in FIG. 1, but with the rear housing removed.
Figure 3:
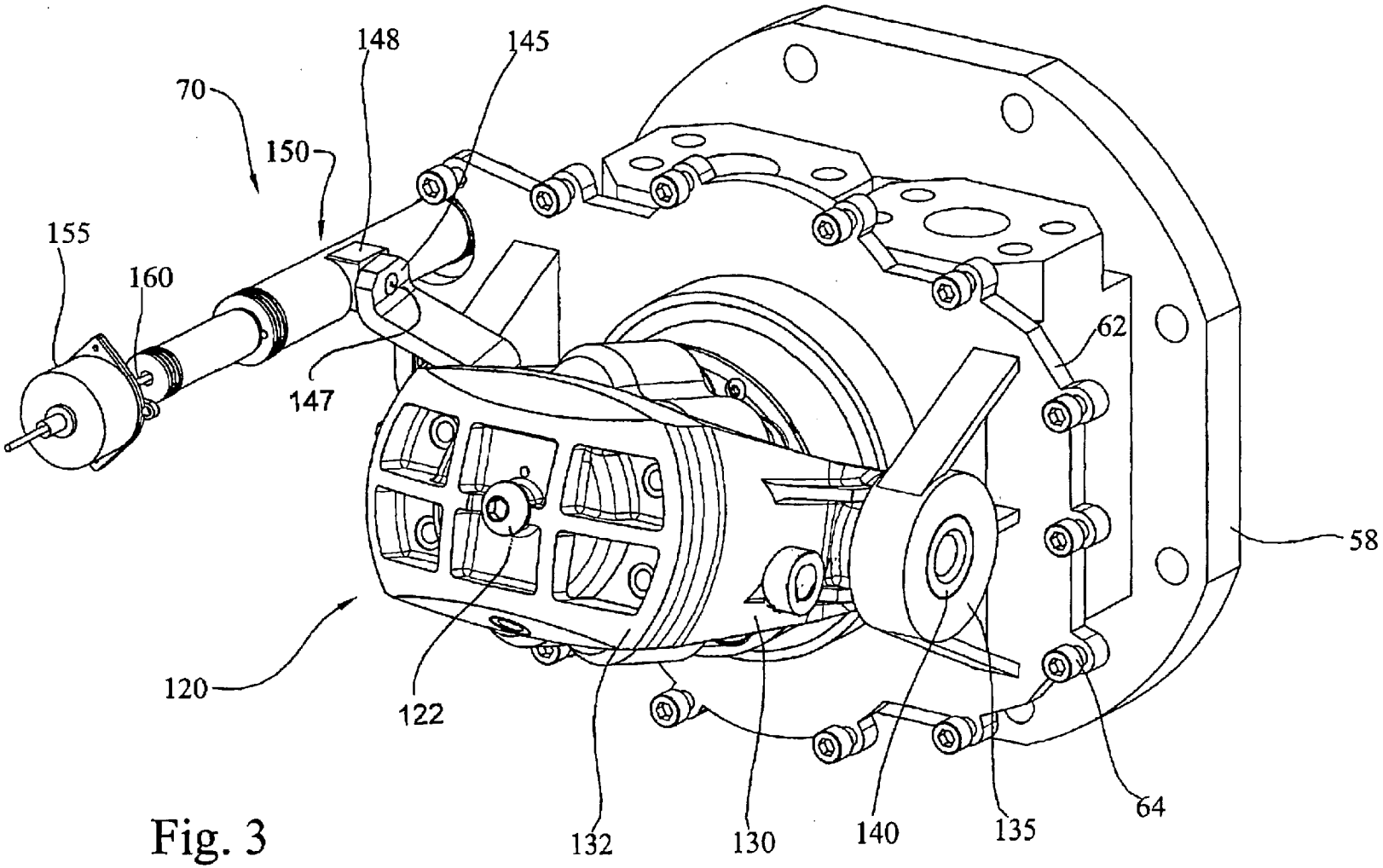
FIG. 3 is a perspective view from the rear side of the pump/motor unit shown in FIG. 2.

A rear housing 58 is provided for enclosing a motive assembly 60 of the pump/motor 50, shown in FIGS. 2 and 3 with the rear housing 58 removed. The rear housing 58 is attached to a rear flange 62 of the manifold block 54 by fasteners, such as Allen head machine screws 64 or the like. An integral sleeve 66 in the side of the rear housing 58 receives a displacement control assembly 70 by which the displacement of the pump or motor 50 can be continuously varied from zero to its full displacement. The operation of the displacement control 70 will be explained in detail below.

Figure 41:
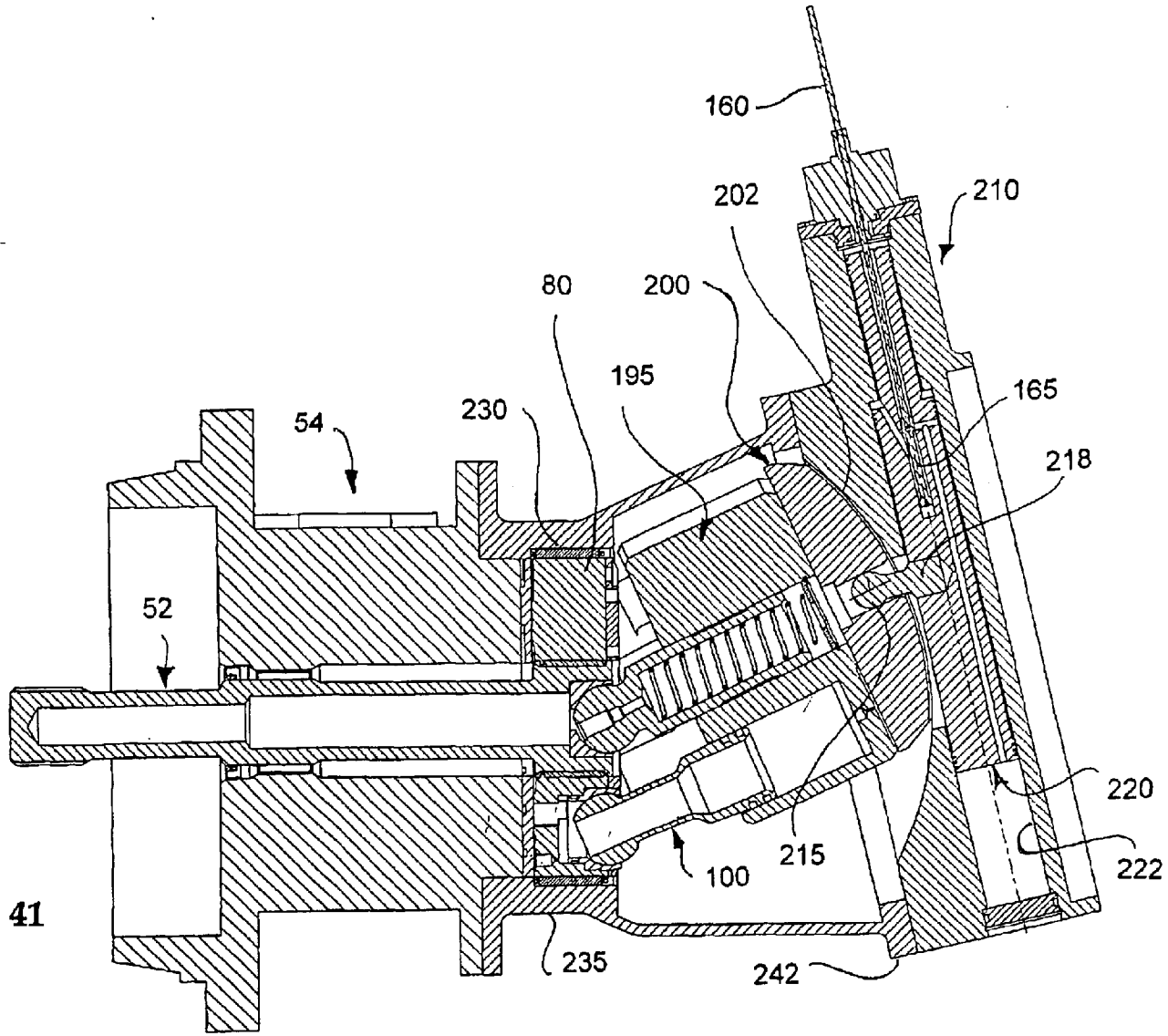
FIG. 41 is a sectional elevation of a second embodiment of the invention using a cylindrical socket to control displacement instead of the yoke arrangement used in the embodiment of FIGS. 1–4.
Figure 43:
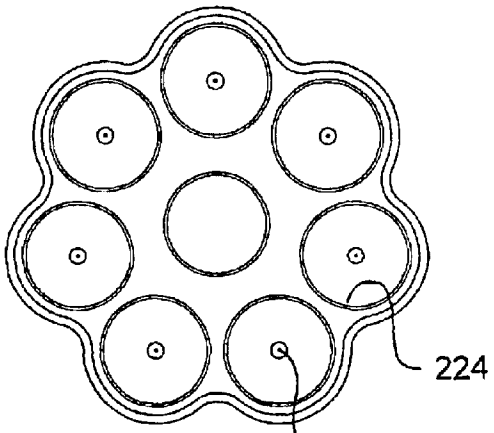
FIGS. 42–45 are various views of the cylinder block shown in FIG. 41.
Figure 45:
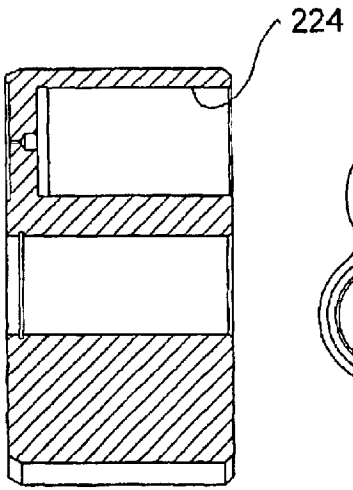
Figure 42:
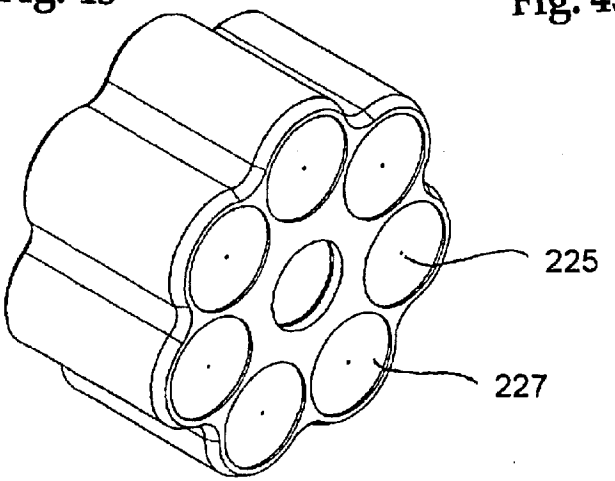
Figure 44:
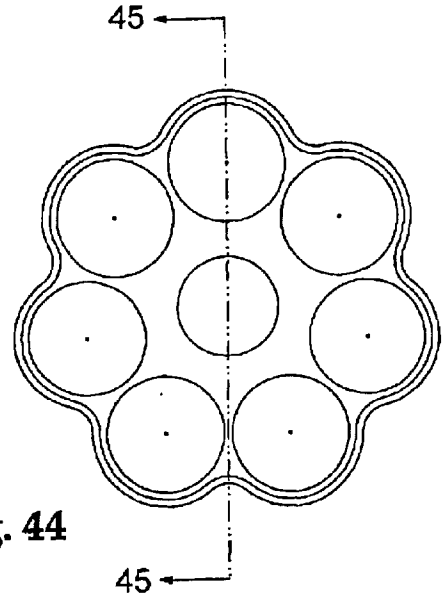
Figure 47:
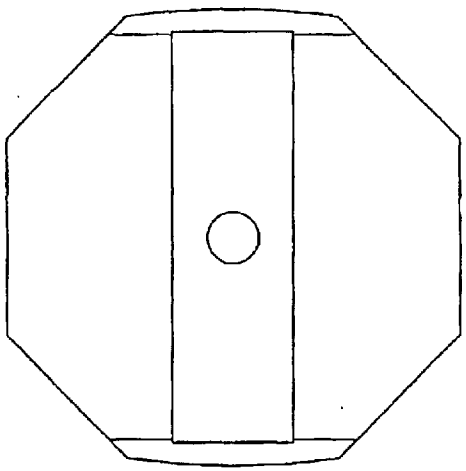
FIGS. 46–49 are various views of the slide block shown in FIG. 41.
Figure 46:
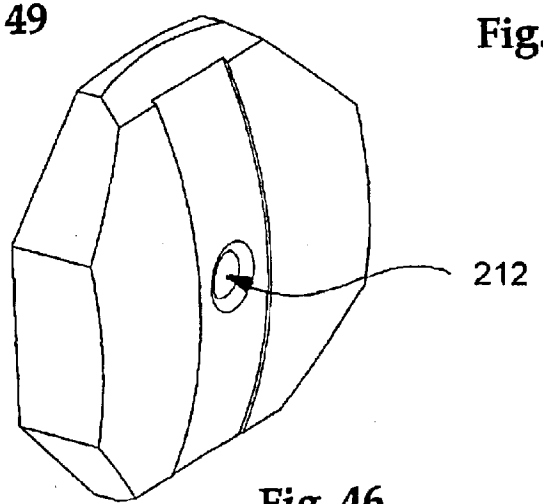
Figure 49:
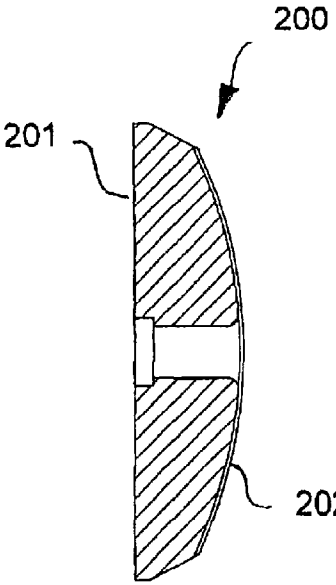
Figure 48:
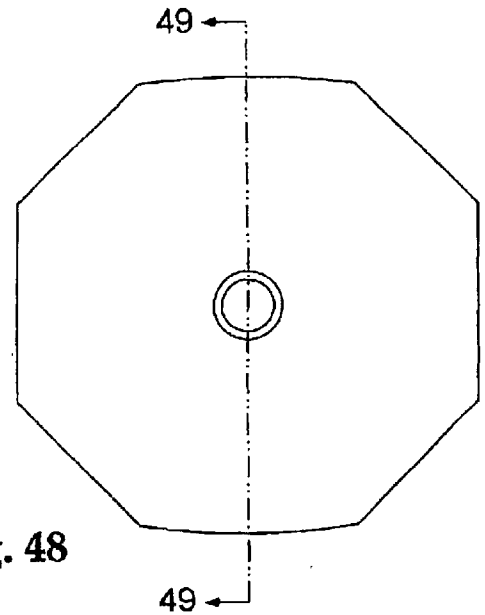
Figure 52:
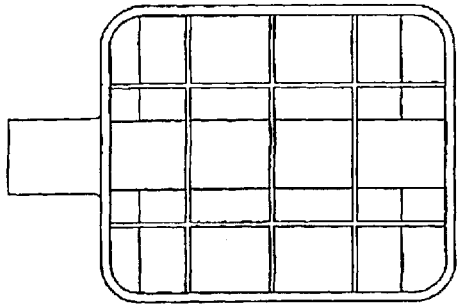
FIGS. 50–54 are various views of the cylindrical socket and control cylinder shown in FIG. 41.
Figure 50:
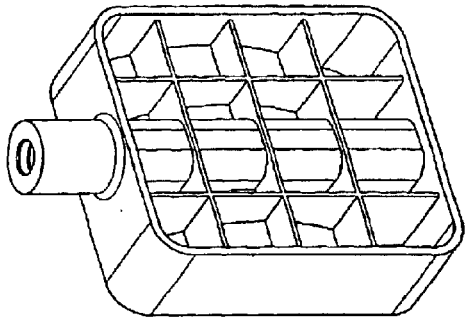
Figure 54:
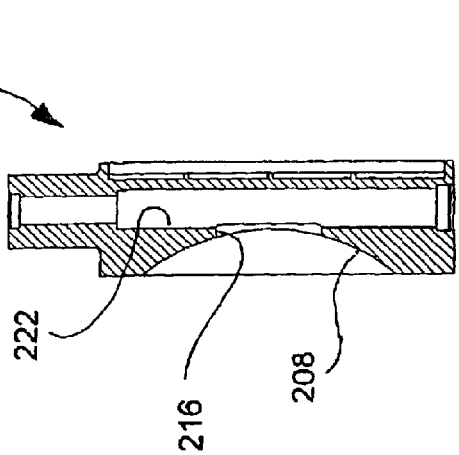
Figure 51:
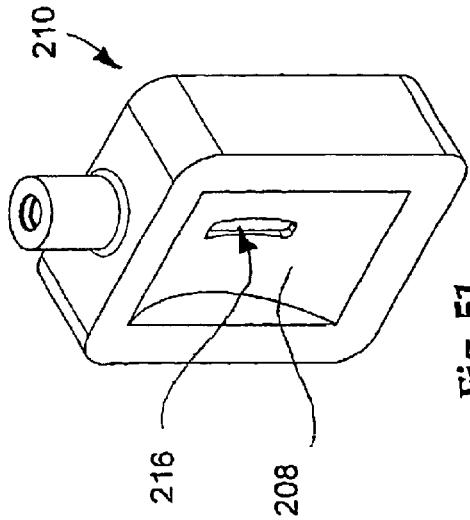
Figure 53:
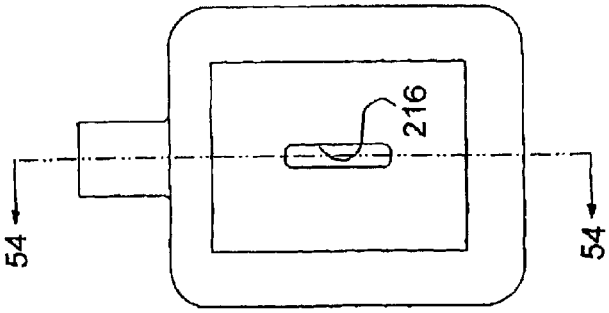

The drive shaft 52 has an inner end 73 that is splined and engaged with mating splines in an axial opening 75 in a torque plate 80, shown in detail in FIGS. 5–8. The torque plate 80 is supported for rotation about the axis 82 of the pump/motor 50 on the end of the drive shaft 52. Alternatively, for a pump/motor unit having a more severe duty cycle, the inner needle bearing on the drive shaft 52 could be eliminated and the torque plate 80 could be supported on a large diameter needle bearing as in the embodiment of FIG. 41. That large diameter needle bearing would running against a hardened support ring (not shown) pressed onto a cylindrical axially protruding boss 88 on the rear of the front housing 54. A port plate 90 is interposed in a shallow cylindrical recess 89 in the rear face of the manifold block 54 in contact with the front face of the torque plate 80 for a purpose to be explained in detail below.

As shown most clearly in FIGS. 4–8, the torque plate 80 has a plurality of openings 92 equally spaced around the torque plate communicate therethrough between its rear or piston-side face 94 and its front or manifold-side face 95.

Figure 11:
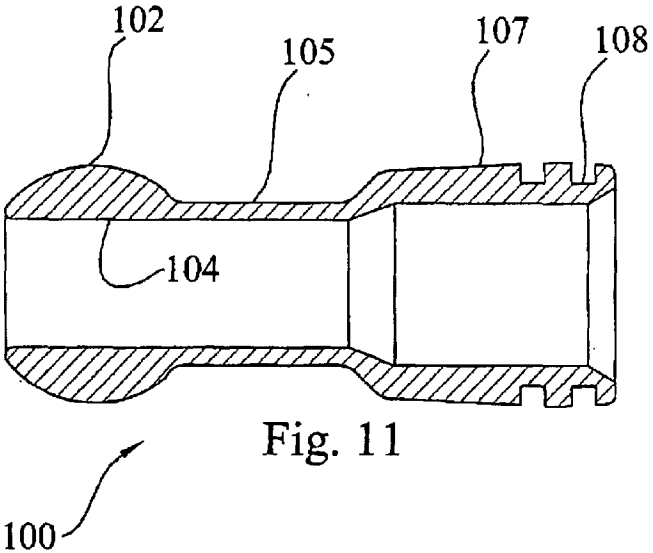
FIGS. 9–11 are various views of one of the pistons in the unit shown in FIG. 4.
Figure 9:
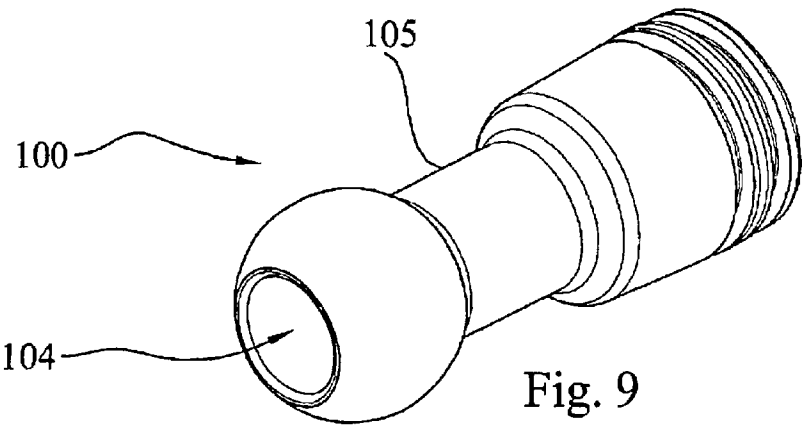
Figure 10:
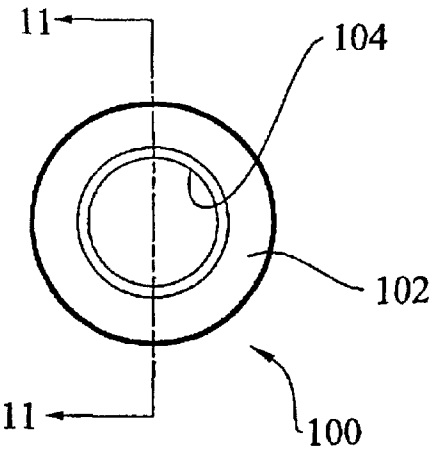
Figure 21:
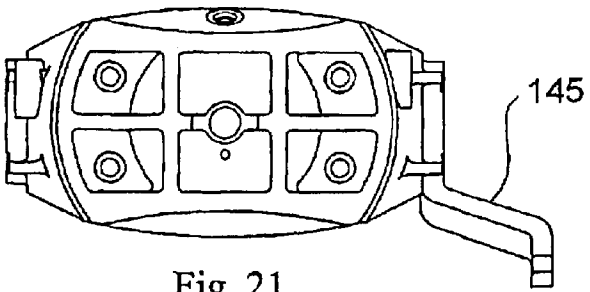
FIGS. 17–21 are various views of the yoke in the unit shown in FIG. 4.

The openings 92 each include a stepped cylindrical bore 96 having a spherical socket or an insert 97 having a spherical seat in the rear face 94 of the torque plate, and a kidney-shaped slot 98 opening in the front face 95. A plurality of pistons 100, shown in detail in FIGS. 9–11, each having a spherical piston head 102 engaged in the spherical seat in the insert 97 of a respective one of the openings 92, is in fluid communication with the openings 92 by way of a through bore 104 in the pistons 100. The piston heads 102 are retained in the sockets 96 by a staking or peening the end of the insert 97 over the piston heads, and the inserts are held in place with a retainer plate 106, in turn held in place against the rear face of the torque plate 80 by screws 109. The pistons each have narrow neck 105 and a slightly flaring tubular skirt having annular grooves 108 for receiving piston rings (not shown). The torque plate 80 is a stressed only moderately in operation, so it can be an economical powered metal construction, thereby reducing the cost of the pump/motor 50. The port plate 90 is provided for easy replacement in the event it becomes worn. Alternatively, the end face of the manifold block 54 can itself be used as the port plate, as described in more detail below, for a more economical unit that would not be intended for repair or rebuilding.

Figure 4:
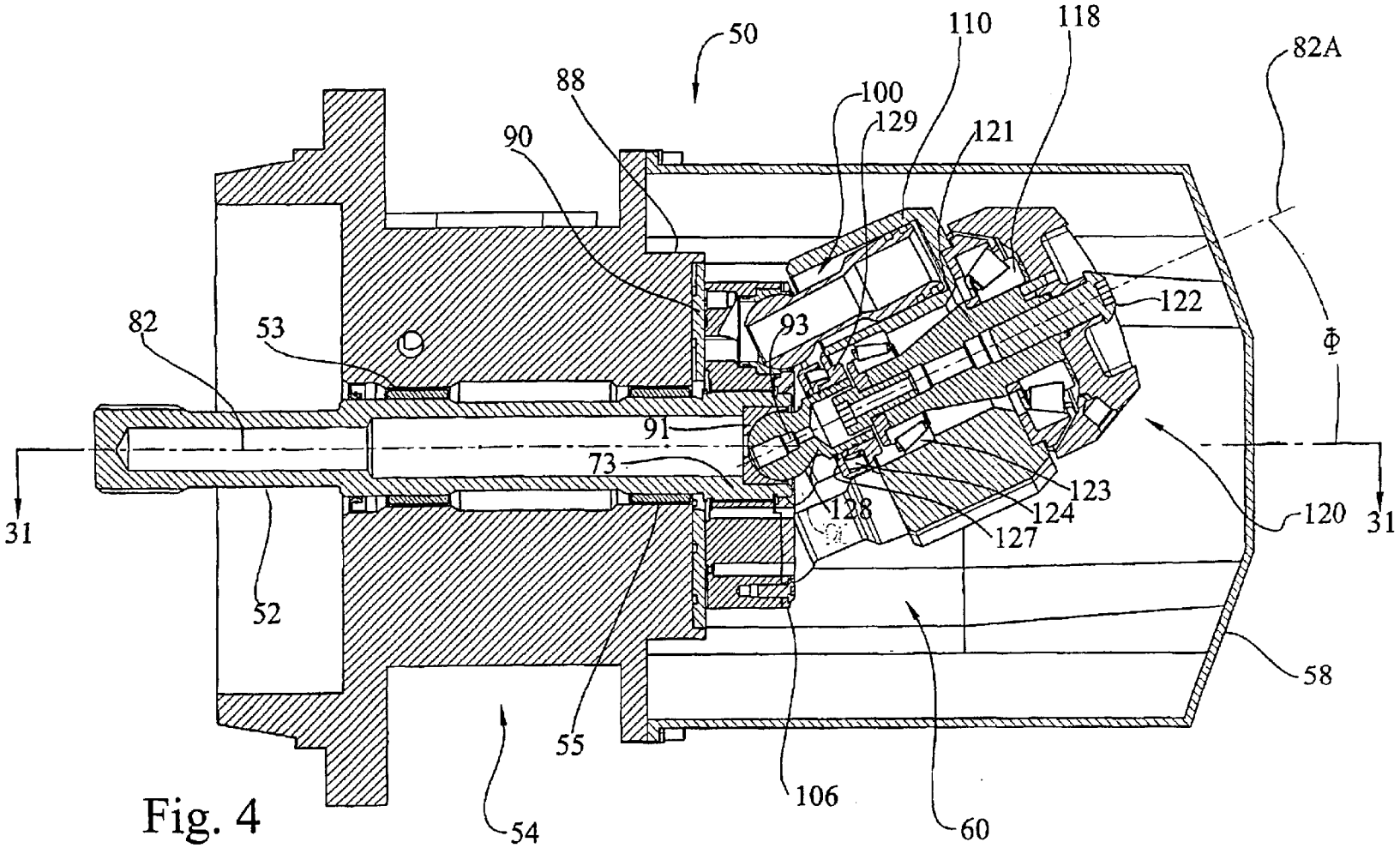
FIG. 4 is a sectional elevation of the pump/motor unit shown in FIG. 1
Figure 8:
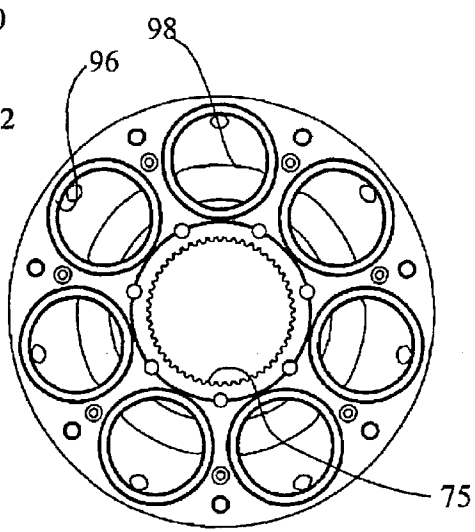
FIGS. 6 and 8 are elevations of the piston side and manifold side, respectively, of the torque plate shown in FIGS. 5 and 5*a;*
Figure 7:
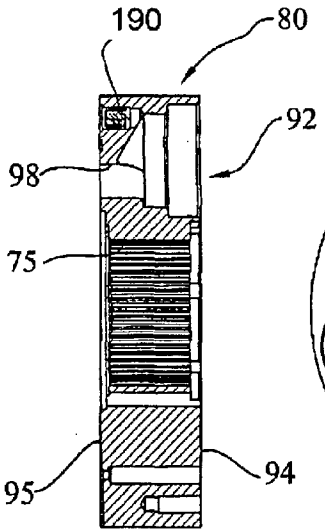
FIG. 7 is a sectional elevation of the torque plate along lines 7—7 in FIG. 6.
Figure 31:
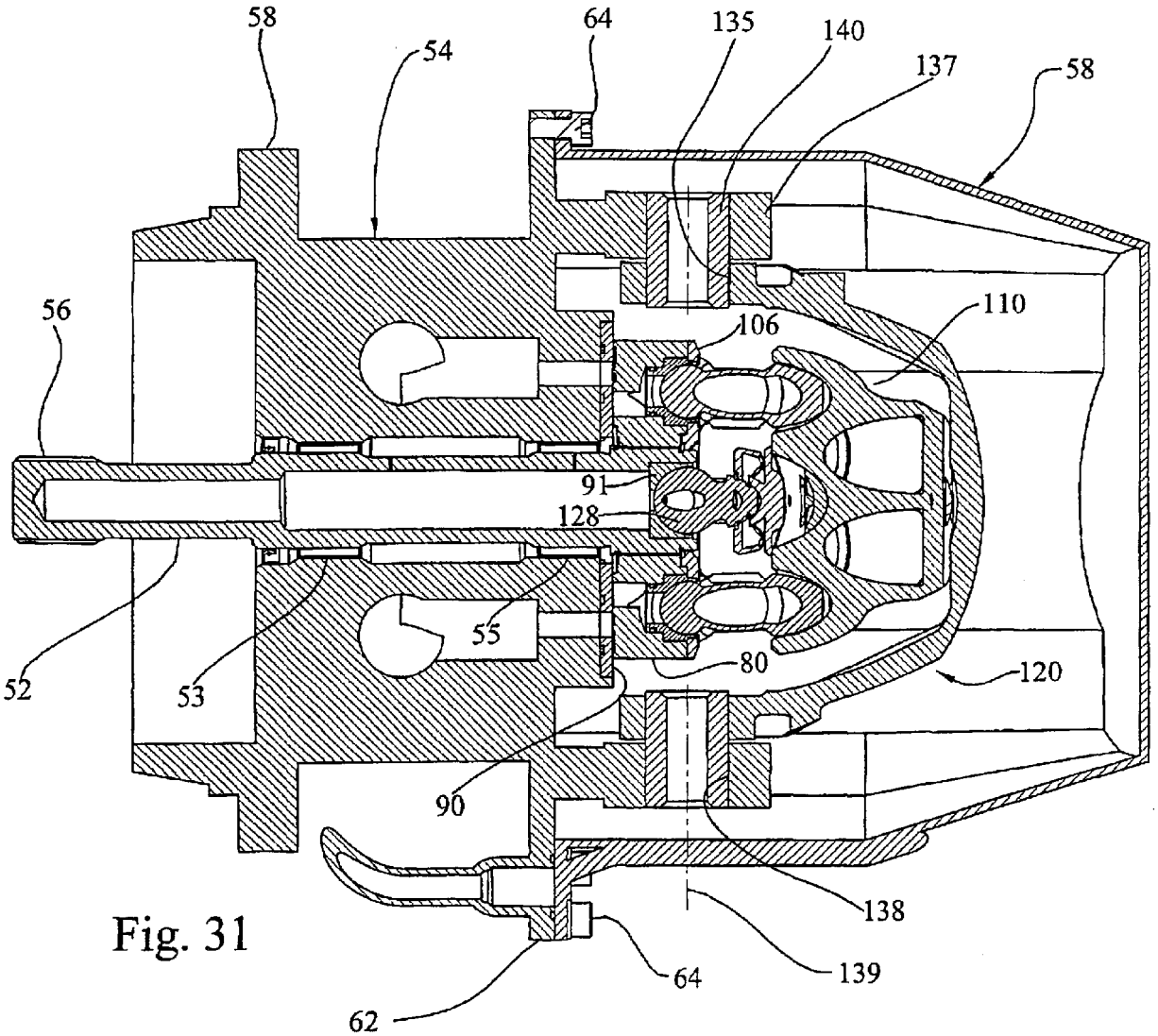
FIG. 31 is a sectional elevation along lines 31—31 in FIG. 4.

A cylinder block 110, shown in detail in FIGS. 12–16, includes a plurality of blind cylinders 112 opening in the front end of the cylinder block. The cylinders 112 are dimensioned to receive the skirts 107 of the pistons 100. A central bore 114 extends through the cylinder block 110, and a flat annular shallow recess 116 is machined in the end face of the cylinder block 110 concentric with the bore 114 face for receiving the end of an outer race of a tapered roller bearing 118 in a bearing well 119 of a yoke 120 pivotally mounted on gudgeons 137 fixed to the manifold block 54, as shown in FIGS. 3 and 31. The yoke is shown in detail in detail in FIGS. 17–21. The yoke 120 provides axial support for the cylinder block 110 and also supports a bearing post 121, as shown in FIG. 4, attached at its rear end by a sturdy Allen head machine screw 122. Two tapered roller bearings 118 and 123 are mounted on the bearing post 121 for radially supporting the cylinder block 110.

Figure 24:
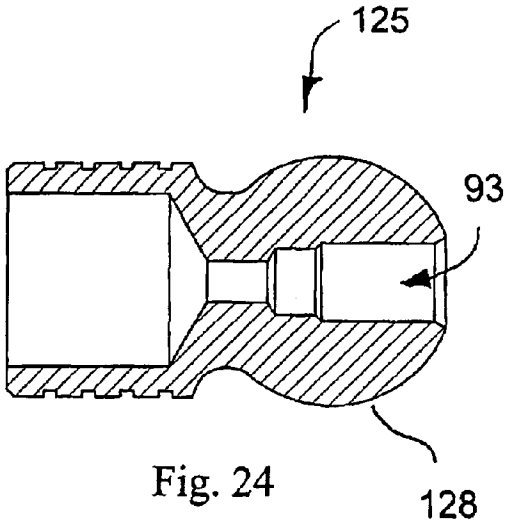
FIGS. 22–24 are various views of the guide tube in the unit shown in FIG. 4.
Figure 22:
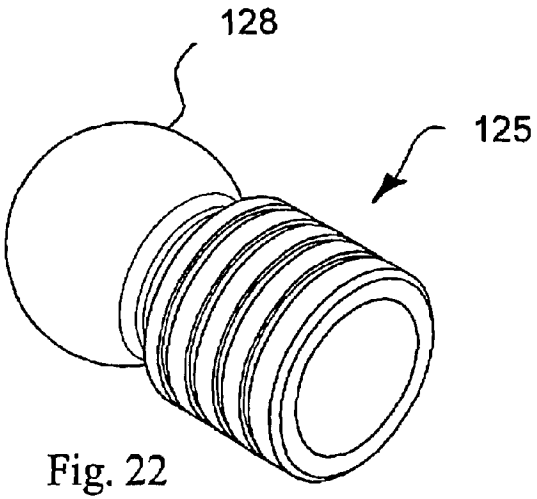
Figure 23:
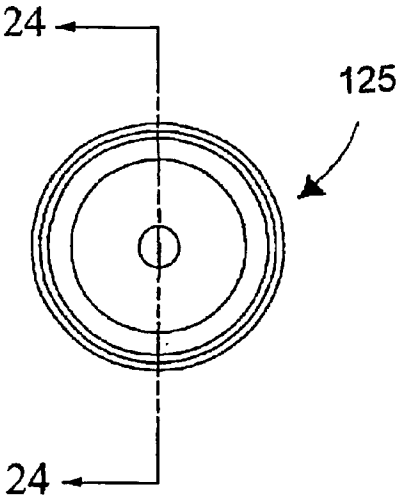
Figure 25:
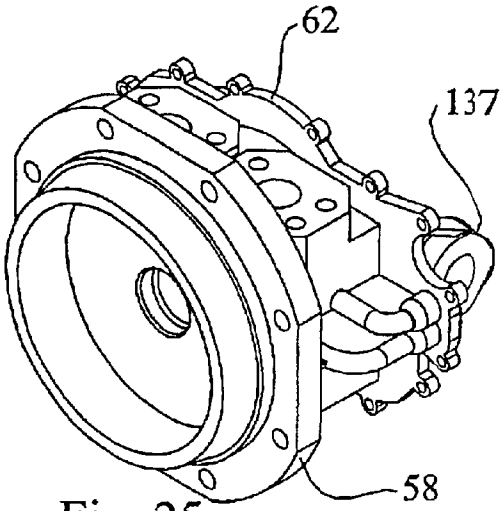
FIGS. 25–30 are various views of the manifold block in the unit shown in FIG. 4.
Figure 26:
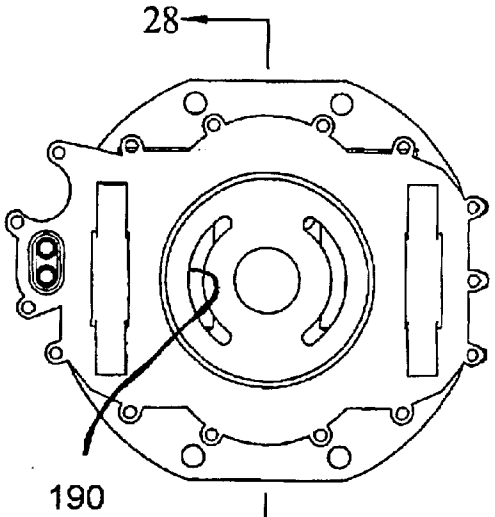
Figure 29:
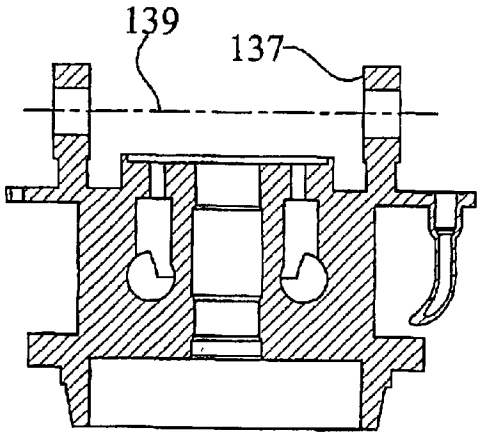
Figure 28:
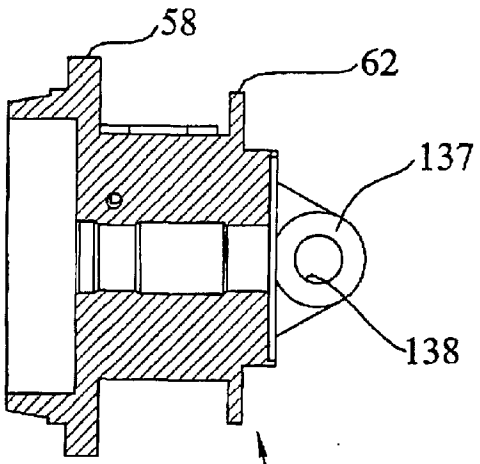
Figure 30:
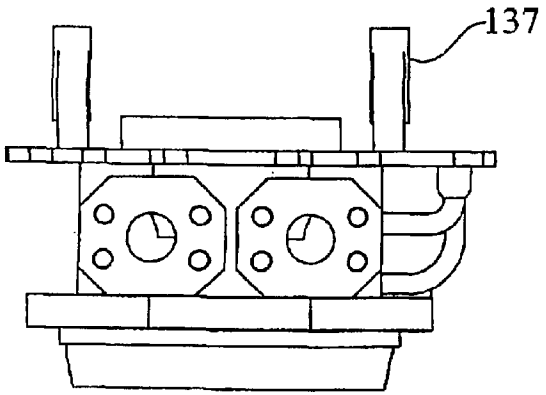
Figure 27:
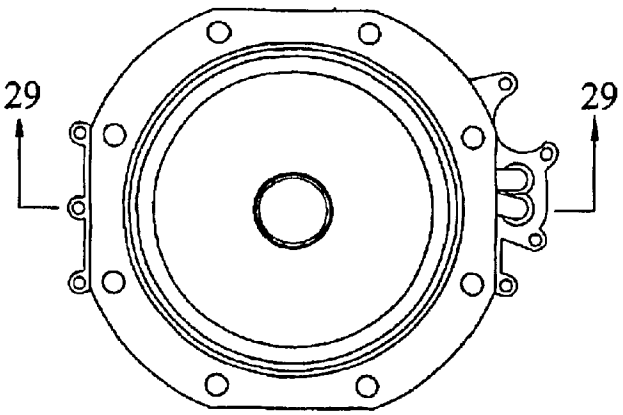

An axial guide tube 125, shown in detain in FIGS. 22–24, is mounted in a spherical socket 91 in the end of the drive shaft 52 to provide a reaction surface for a wave spring 124 that preloads the torque plate 80 against the port plate 90 to ensure a fluid tight interface therebetween during start-up of the pump/motor 50. A cup 127 retained on the guide tube 125 with a snap ring holds the wave spring 124, and a flanged sleeve 129 slidably mounted on the guide tube 125 bears against the end face of the cylinder block. The axial preload force is transmitted to the torque plate 80 through a spherical ball 128 at the inner end of the guide tube 125 to the socket 91 and the drive shaft 52, and thence to the torque plate 80 by way of a snap ring between the drive shaft 52 and the torque plate 80.

The retainer plate 106 engages the bore inserts 97 to retain them in the bores 96 and supports the inserts 97 at the diameter of the spherical balls 102 on the ends of the pistons 100 to minimize torque loads on the pistons 100. Lateral forces exerted by the pistons 100 are borne by the inserts 97 and transmitted directly to the retainer plate 106 and thence to the drive shaft 52 where they can be reacted by the bearings 53 and 55. The spline connection 75-73 between the torque plate 80 and the drive shaft 52 is thus relieved from carrying these lateral forces.

An axial hole 93 in the spherical ball 128 may be provided to allow a flow of lubrication from the axial bore in the drive shaft for the spherical interface of the spherical ball 128 in the socket 91, and also a flow of lubricant through the bore in the guide tube 125 to the bearings 118 and 123. Alternatively, the housing could be filled with oil for lubrication by flooding the entire motive assembly 60 in oil. The center of curvature of the spherical ball 128 in the socket 91 lies on a transverse plane containing the centers of curvature of all the spherical piston heads 102 and the spherical seats of the inserts 97.

Figure 17:
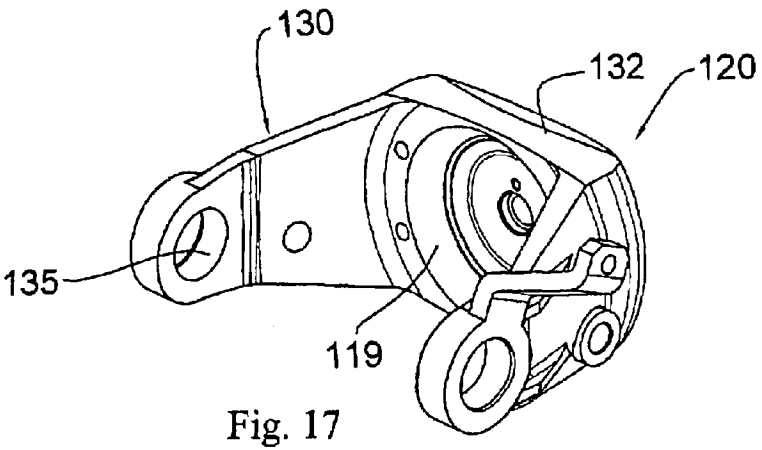
Figure 20:
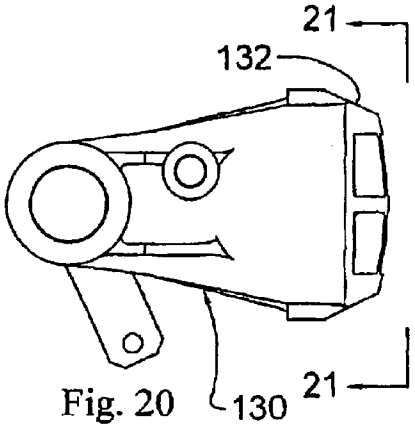
Figure 18:
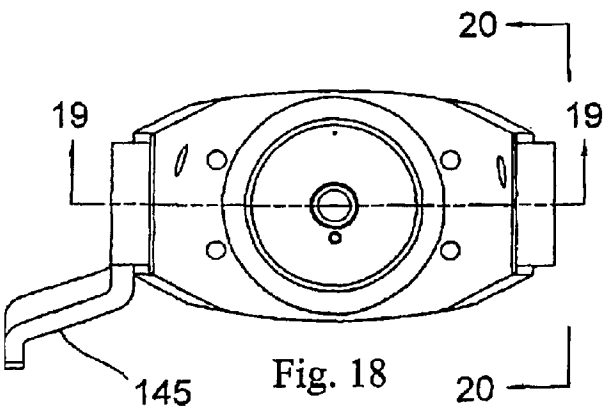
Figure 19:
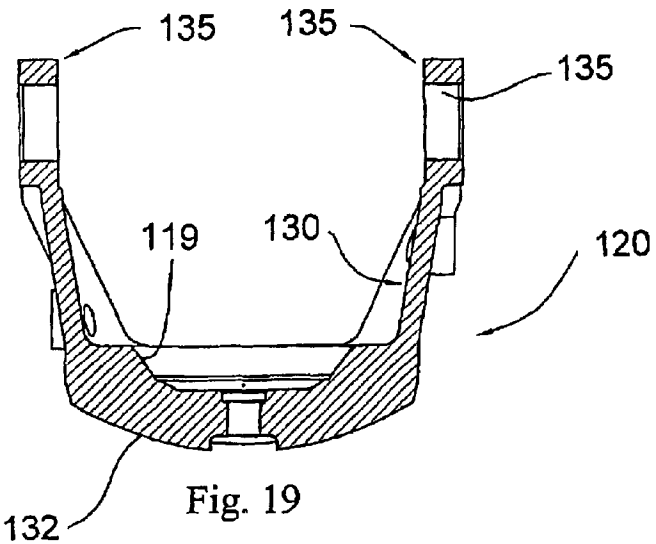

As best shown in FIGS. 3, 4 and 17, the yoke 120 supports the cylinder block 110, against the force of fluid pressure in the cylinders 112, for rotation about the bent axis 82A. A pair of arms 130 project forwardly from a base ring 132, and a bearing hole 135 in the end of each arm 130 receives a pin 140 by which the yoke 120 is pivotally supported on the gudgeon 137. The gudgeon 137 also has a hole 138 therethrough on a swivel axis 139 transverse to the central axis 82 and lying in the same transverse plane containing the centers of curvature of the spherical ball 128 and socket 91 and the spherical piston heads 102. This pivot axis 139 for the yoke 120 allows the cylinder block to remain on its axis of rotation about the bent axis 82A regardless of the tilt angle of the yoke 120.

Figure 32:
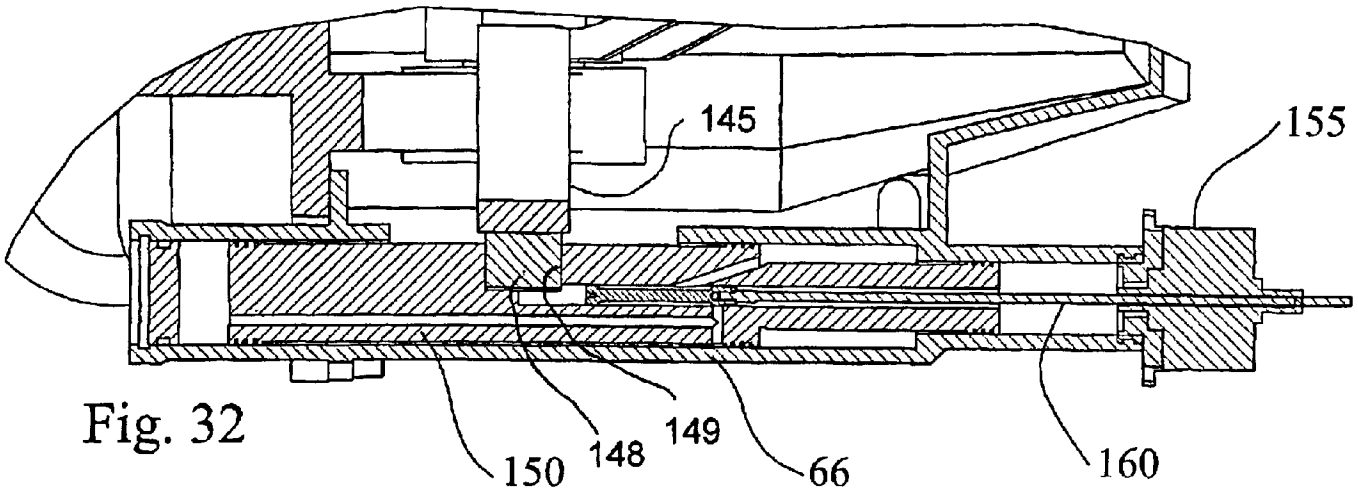
FIGS. 32–33 are sectional views of the displacement control assembly shown in FIGS. 1–3.
Figure 33:
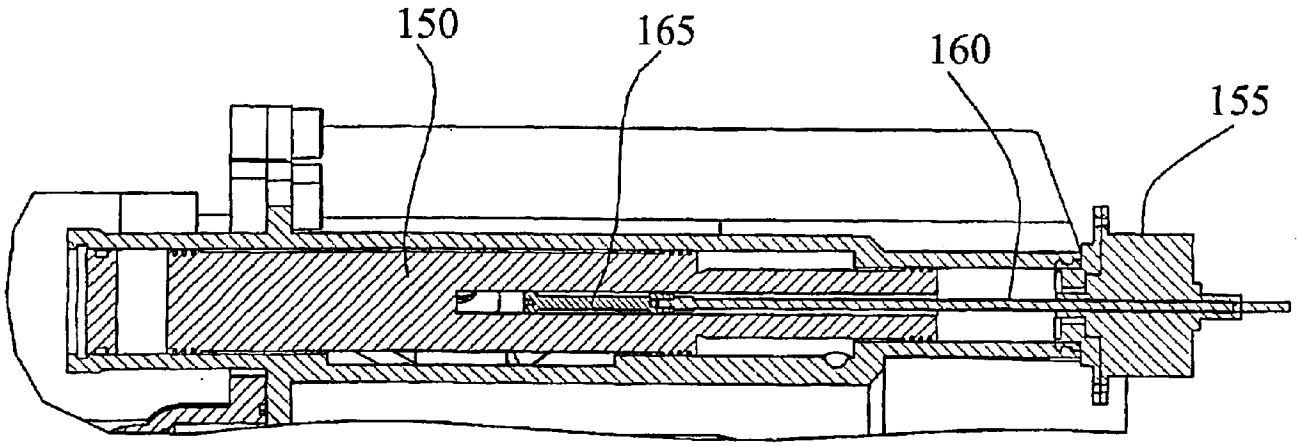
Figure 37:
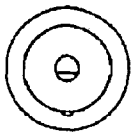
FIGS. 34–37 are various views of the control piston shown in FIGS. 1–3 and 32–33.
Figure 34:
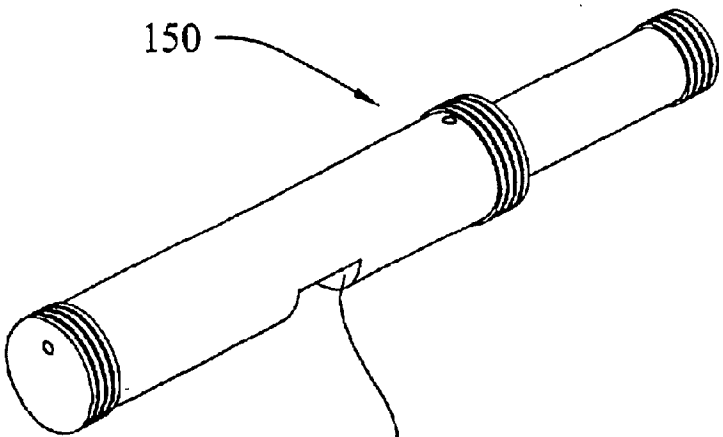
Figure 36:
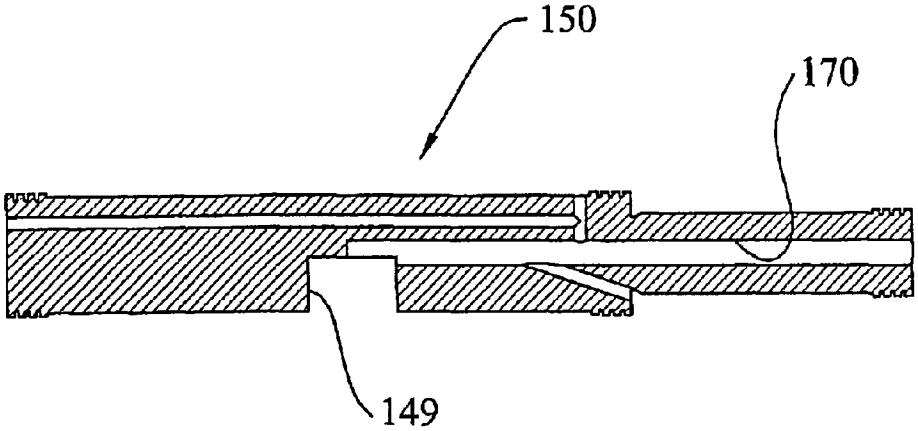
Figure 35:
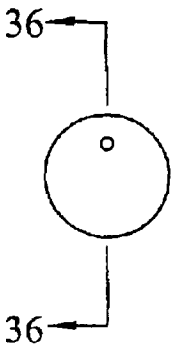

The angle that the bent axis 82A makes with the axis 82, and thus the displacement of the pump/motor 50, is controlled by the displacement control assembly 70. The displacement control assembly 70 includes a leader-follower valve designed to control the tilt angle of the yoke 120. It is coupled to a crank arm 145 of the yoke 120, as best shown in FIGS. 3 and 32, by engagement of a linking pin 147 to a coupling cube 148 which fits into a notch 149 in a main control piston 150, shown in FIGS. 3 and 32–37. A servo motor or stepper motor 155 moves a control rod 160 attached to a control spool 165 inside a bore 170 in the control piston 150. The control piston 150 is driven by system fluid pressure to position itself at the position on the control spool 165 shown in FIG. 32, pulling the coupling cube 148 and the linking pin 147 on the crank arm 145 with it. The transverse component of the motion of the pivoting crank arm 145 when the yoke pivots about its pivoting axis 139 is accommodated by the coupling cube 148 sliding in the notch 149.

Figure 40:
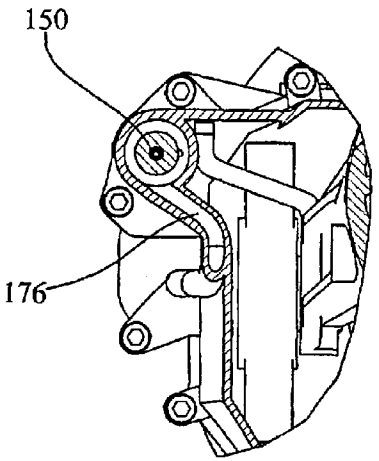
FIGS. 38–40 are various views of fluid supply flow network to the displacement control assembly shown in FIGS. 32–33.
Figure 38:
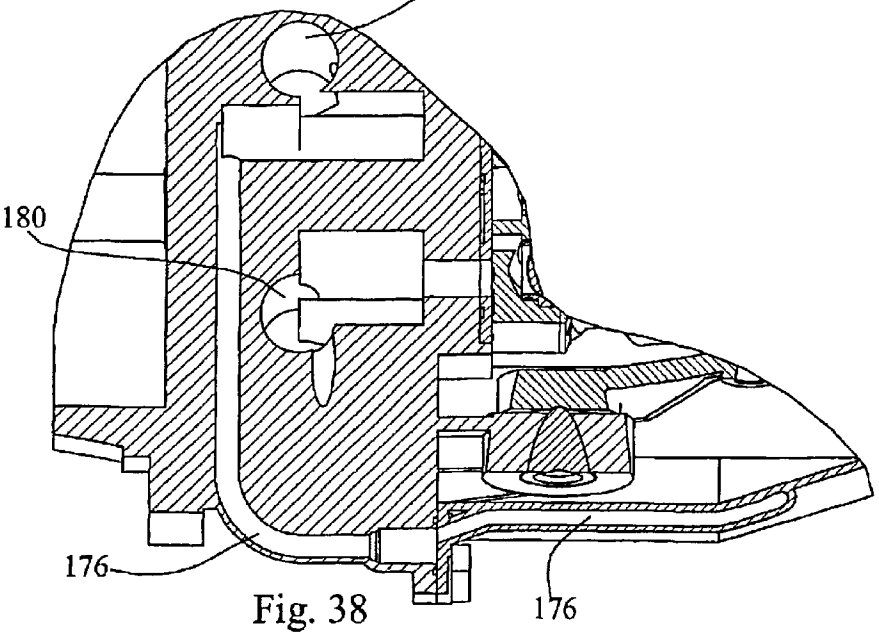
Figure 39:
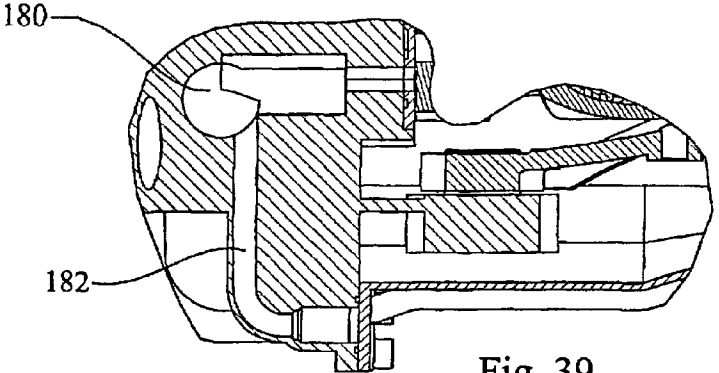

System pressure for moving the control piston 150, as shown in FIGS. 38–40, is provided by way of a flow channel 175 from the high pressure manifold 176 of the pump/motor 50, as shown in FIG. 38, and the low pressure side of the control piston is in fluid communication with the low pressure port 180 via a low pressure flow channel 182.

In operation, the pump or motor is connected to fluid flow couplings at the high and low pressure ports 175 and 180. The drive shaft is connected to a driving or driven apparatus and fluid is admitted to the pump/motor 50 through the ports 175 and 180. If the unit is operating as a pump, the drive shaft 52 is driven and rotates the torque plate 80, driving the cylinder block 120 through the pistons. The bent axis of the cylinder block causes the pistons to reciprocate in the cylinders 112, one full cycle for each rotation of the cylinder block. Fluid displaced from the cylinders 112 by the pistons 100 is commutated by the openings in the torque plate 80 and the kidney-shaped openings in the port plate 90, shown in FIG. 26. The displacement is controlled by controlling the tilt angle $\Phi$ that the cylinder block axis 82A makes with the central axis 82, using the displacement control assembly 70.

Figure 6:
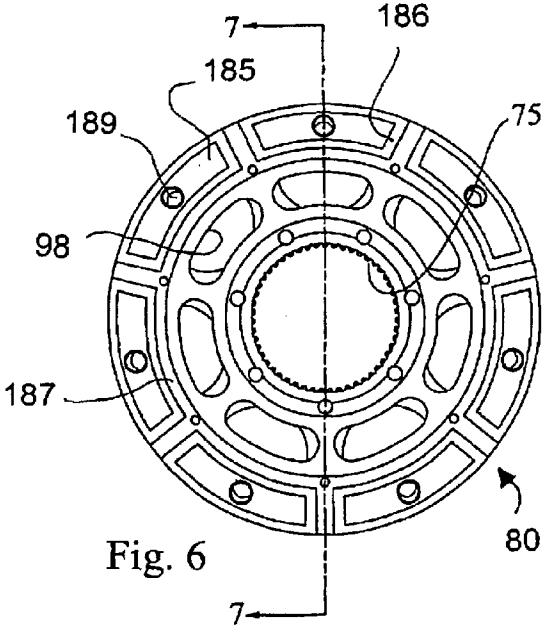
Figure 5:
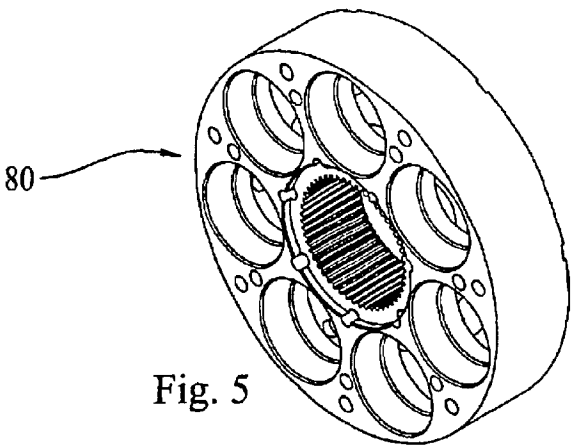
FIGS. 5 and 5*a* are perspective views from the piston side and manifold side, respectively, of the torque plate in the unit shown in FIG. 4.
Figure 5A:
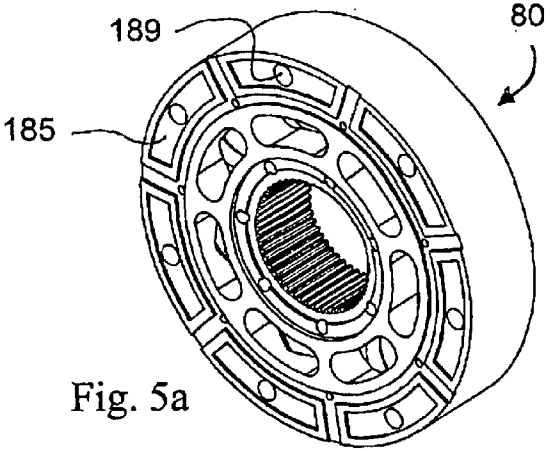

System pressure is used to float the torque plate 80 on the port plate under all load and displacement conditions using a combination of a fixed and controlled hydrostatic bearing, as shown in FIGS. 5*a* and 6. The fixed hydrostatic bearing is an "underbalance" bearing that will carry approximately 50% of the axial load exerted by the pistons of the torque plate 80, and the controlled "overbalance" hydrostatic bearing will support about 150% of the axial load.

The fixed hydrostatic bearing is supplied by the fluid pressure in the ports 98. The controlled hydrostatic bearing is in the form of shallow individual wedge recesses 185 radially outside the ports 98 and the piston sockets in the torque plate 80. The wedge recesses 185 are defined by surrounding land frames 186 which in turn are delineated by a shallow annular groove 187 having shallow radial spoke grooves 188 extending between each of the land frames 186. A hole 189 extends from the center of each wedge recess 185 to the stepped bore 92 to supply fluid under system pressure to the wedge recesses 185 to provide the fluid pressure to support the torque plate 80 on a fluid cushion on the port plate 90. An orifice 190 (shown only in FIG. 7) is pressed into the holes 189 to limit the flow rate into the recesses 185. The excess load carrying capacity of the controlled hydrostatic bearing separates the torque plate 80 from the port plate 90 to the extent that leakage flow around the land frames 186 into the grooves 187 and 188 exceeds the flow capacity through the orifices 190 and creates a fluid pressure drop across the orifices between the stepped bore 92 and the wedge recesses 185. This pressure drop reduces the axial force exerted by the controlled hydrostatic bearing until the axial spacing between the torque plate 80 and the port plate 90 reaches an equilibrium where the axial force exerted by the two hydrostatic bearings just balances the axial force exerted by the pistons 100. The leakage from this hydrostatic bearing can be limited to an acceptable rate by correct choice of the orifice diameter so that the desired balance of leakage through the bearing and reduced torque loss is achieved.

This bent axis embodiment is advantageous because it has greater efficiency and power density, can result in a reduction in size, weight, complexity and cost, and has the ability to run faster than a same size swashplate unit. It is thus possible to use gear ratios that make the bent axis unit spin faster, thereby increasing its torque and power output when operated as a motor, or increasing its flow capacity when operating as a pump.

Another embodiment of the invention is shown in FIGS. 41–54 in which a cylinder block 195 runs against a front face 201 of a slide block 200, shown in detail in FIGS. 46–49. The slide block 200 has a cylindrical rear face 202 that slides in a cylindrical recess 208 of support block 210. The slide block 200 has a central opening 212 that receives a spherical knob 215 of a pin 218 pressed into a transverse hole in a control piston 220 and extends through a slot 216 in the center of the cylindrical recess 208. The control piston 220, which operates like control piston 150 shown in FIGS. 2, 3 and 32–37, operates in a cylinder 222 in the support block 210. The displacement of the motive unit is controlled by controlling the tilt angle that the cylinder block axis 82A makes with the central axis 82, using the control piston 220 whose position in the cylinder 222 is controlled by the position of a control rod 160 attached to a control a 165 inside a bore in the control piston 220 under the control of the servo motor or stepper 155, as in the embodiments shown in FIGS. 1–4.

The cylinder block 195 has a series at blind cylinders 224, each containing a hollow piston 100. Pressurized fluid and reaching fluid flow into and out of the blind cylinders 224 through the hollow piston 100, as in the embodiment of FIG. 4. The floor of each cylinder 224 in the cylinder block 195 has an orifice 225 that admits a limited flow of pressurized fluid into a shallow recess 227 behind each cylinder, constituting a hydrostatic bearing for the cylinder block 195. The pressure in each cylinder 224 varies according to the phase of the stroke and the input speed, torque, or pressure. The hydrostatic bearing inherently balances the pressure behind each cylinder 224 provided the orifice 225 is large enough to permit an adequate flow of fluid into the recess 227 to make up for leakage out of the recess 227.

A radial needle bearing 230 surrounds the torque plate 80 to provide radial support for the torque plate to react the lateral forces exerted against it by the pistons 100. The radial needle bearing 230 runs against a cylindrical sleeve 235 attached to the manifold block 54. In this embodiment, the cylindrical sleeve 235 is an integral part of a housing 240 surrounding the cylinder block 195 and providing a mounting flange 242 at its rear end for connecting the support block 210 to the manifold block and reacting the axial forces of the cylinder block 195 back to the manifold block.

Obviously, numerous other modifications, combinations and variations of the preferred embodiments described above are possible and will become apparent to those skilled in the art in light of this specification. For example, many functions and advantages are described for the preferred embodiment, but in some uses of the invention, not all of these functions and advantages would be needed. Therefore, we contemplate the use of the invention using fewer than the complete set of noted functions and advantages. Moreover, several species and embodiments of the invention are disclosed herein, but not all are specifically claimed, although all are covered by generic claims. Nevertheless, it is our intention that each and every one of these species and embodiments, and the equivalents thereof, be encompassed and protected within the scope of the following claims, and no dedication to the public is intended by virtue of the lack of claims specific to any individual species. Accordingly, it is expressly intended that all these embodiments, species, modifications and variations, and the equivalents thereof, are to be considered within the spirit and scope of the invention as defined in the following claims, wherein

We claim:

1. A hydraulic pump/motor, comprising:

a drive shaft mounted in a manifold block on a central axis;

a torque plate coupled to said drive shaft for torque transmission therebetween;

a hydrostatic fluid bearing between said torque plate and said manifold block for axially supporting said torque plate on a pressurized fluid film on said manifold block, said hydrostatic bearing including recesses surrounded by lands in an axially facing surface of said torque plate adjacent said manifold block, said recesses communicating with hollow pistons for supplying fluid under pressure to said recesses for creating a pressurized fluid cushion for supporting said torque plate axially on said manifold block;

a bent axis motive unit having a base connected to said manifold block for arcuate translation about a swivel axis transverse to said central axis;

a cylinder block supported for rotation on said base about a cylinder block axis and having said hollow pistons in blind cylinders in said cylinder block, said pistons having spherical piston heads engaged in spherical sockets in said torque plate;

fluid flow channels communicating through said torque plate for convey fluid pressurized in said cylinders when said pistons are driven into said cylinders by rotation of said cylinder block about said cylinder block axis when said cylinder block is tilted at an angle to present said cylinder block to said torque plate at a diverging angle from said central axis.

2. A hydraulic pump/motor as defined in claim 1, wherein said base includes a yoke having a pair of arms projecting from a yoke base, each arm being pivotally connected to said manifold block for pivoting about said swivel axis lying in a plane that also containing centers of curvature of said spherical piston heads;

whereby said cylinder block remains on its axis of rotation about said axis regardless of tilt angle of said yoke.

3. A hydraulic pump/motor as defined in claim 1, further comprising:

a control piston in a control cylinder, said control piston being positionable in said control cylinder by positioning a control rod attached to a control spool inside a in said control piston.

4. A hydraulic pump/motor as defined in claim 1, wherein:

said base includes a slide block having a cylindrical rear face that slides in bore a cylindrical recess of a support block.

5. A hydraulic pump/motor as defined in claim 4, further comprising:

a control piston in a control cylinder, said control piston being positionable in said control cylinder by positioning a control rod attached to a control spool inside a bore in said control piston;

said slide block has a central opening that receives a pin projecting from said control piston for controlling said tilt angle that said cylinder block axis makes with a central axis of said drive shaft.

6. A hydraulic pump/motor as defined in claim 1, further comprising:

a radial bearing for radially supporting said torque plate in position on said manifold block.

7. A hydraulic pump/motor as defined in claim 6, wherein:

said radial bearing surrounds said torque plate and reacts transverse loads exerted on said torque plate by said pistons through said radial bearing directly to a supporting cylindrical sleeve connected to said manifold block.

8. A hydraulic pump/motor as defined in claim 6, wherein:

said radial bearing surrounds said drive shaft and supports said torque plate indirectly by virtue of a coupling between said drive shaft and said torque plate.

9. A hydraulic pump/motor as defined in claim 6, wherein:

said torque plate is mechanically coupled to said drive shaft by a spline connection.

10. A hydraulic pump/motor, comprising:

a drive shaft mounted in a manifold block on a central axis;

a torque plate coupled to said drive shaft for torque transmission therebetween, said torque plate having a hydrostatic fluid bearing for supporting said torque plate on a pressurized fluid film on said manifold block;

a bent axis motive unit having a base connected to said manifold block for arcuate translation about a swivel axis transverse to said central axis;

a cylinder block supported for rotation on said base about a cylinder block axis and having hollow pistons in blind cylinders in said cylinder block, said pistons having spherical piston heads engaged in spherical sockets in said torque plate;

fluid flow channels communicating through said torque plate for conveying fluid pressurized in said cylinders when said pistons are driven into said cylinders by rotation of said cylinder block about said cylinder block axis when said cylinder block is tilted at an angle to present said cylinder block to said torque plate at a diverging angle from said central axis;

said hydrostatic fluid bearing includes an underbalance portion provided by fluid pressure in said fluid flow channels communicating through said torque plate, and an overbalance portion having shallow individual recesses that are supplied with fluid under system pressure through an orifice in said individual recesses, said orifices having a limited flow rate into said recesses at system pressure;

whereby fluid pressure in said recesses separates said torque plate from said manifold block and leaks out of said recesses at a rate that exceeds said limited flow rate through said orifices, creating a fluid pressure drop across said orifices and thereby reducing the axial force exerted by said overbalance portion until the axial spacing between the torque plate and said manifold block reaches an equilibrium where the axial force exerted by the underbalance portion and the overbalance portion just balances the axial force exerted by said pistons on said torque plate.

11. A hydraulic pump/motor, comprising:

a drive shaft mounted for rotation about a central axis and extending through a central bore in a manifold block;

said manifold block having a low pressure fluid channel and a high pressure fluid channel opening in an annular surface on said manifold block;

a torque plate coupled to said drive shaft for torque transmission therebetween, and having an annular surface juxtaposed against said annular surface of said manifold block and defining therewith a rotating interface;

a bent axis motive unit having a base supported for arcuate translation about a swivel axis transverse to said central axis, said bent axis motive unit including a cylinder block supported for rotation on said base and having hollow pistons in blind cylinders in said cylinder block, said pistons having spherical piston heads engaged in spherical sockets in said torque plate;

fluid flow channels communicating through said torque plate for conveying fluid pressurized in said cylinders when said pistons are driven into said cylinders by rotation of said cylinder block when said cylinder block is tilted at an angle to present said cylinder block to said torque plate at a diverging axis;

a hydrostatic fluid bearing in said interface and in fluid communication with said fluid flow channels in said torque plate for axially supporting said torque plate on a pressurized fluid film on said manifold block against axial forces exerted by said pistons against said torque plate;

whereby, fluid pressurized in the cylinders is conducted through said hollow pistons to said interface to pressurize the fluid in the hydrostatic fluid bearing during operation.

12. A hydraulic pump/motor as defined in claim 11, wherein:

said hydrostatic fluid bearing includes an underbalance portion provided by fluid pressure in said fluid flow channels communicating through said torque plate, and an overbalance portion having shallow individual recesses that are supplied with fluid under system pressure through an orifice in said individual recesses, said orifices having a limited flow rate into said recesses at system pressure;

whereby fluid pressure in said recesses separates said torque plate from said manifold block and leaks out of said recesses at a rate that exceeds said limited flow rate through said orifices, creating a fluid pressure drop across said orifices and thereby reducing the axial force exerted by said overbalance portion until the axial spacing between the torque plate and said manifold block reaches an equilibrium where the axial force exerted by the two hydrostatic bearings just balances the axial force exerted by said pistons on said torque plate.

13. A process for converting between mechanical torque and fluid pressure, comprising:

applying torque to a drive shaft coupled to a torque plate for rotating said torque plate about a central axis in sliding engagement with a manifold block;

applying said torque from said torque plate to a bent axis motive unit having a cylinder block holding hollow pistons in blind cylinders in said cylinder block by engagement of spherical ends of said pistons protruding from said cylinders in sockets in said torque plate;

supporting said cylinder block for rotation on a base for arcuate translation about a swivel axis transverse to said central axis;

axially supporting said torque plate against forces exerted by said piston on pressurized fluid cushions of a hydrostatic fluid bearing between said torque plate and said manifold block;

pressurizing said fluid cushions through fluid flow channels communicating through said torque plate by conveying fluid pressurized in said cylinders when said pistons are driven into said cylinders by rotation of said cylinder block on said base when said cylinder block is tilted at an angle to present said cylinder block to said torque plate at an angle diverging from said central axis.

14. A process as defined in claim 13, wherein axially supporting said torque plate against forces exerted by said pistons on pressurized fluid cushions of a hydrostatic fluid bearing between said torque plate and said manifold block includes:

exerting an underbalance hydrostatic force on said torque plate by fluid pressure in said fluid flow channels communicating through said torque plate, and exerting an overbalance hydrostatic force on said torque plate in shallow individual recesses by fluid under system pressure supplied through an orifice in each said individual recesses, said orifices having a limited flow rate into said recesses at system pressure.

* * * * *